United States Patent [19]

Seidel et al.

[11] Patent Number: 4,718,867

[45] Date of Patent: Jan. 12, 1988

[54] MULTI-POLE PLUG MECHANISM COMPRISING A CENTERING STRIP WITH A SHIELDING DEVICE

[75] Inventors: Peter Seidel, Groebenzell; Leo Pelzl, Holzkirchen; Karl Zell, Niederpoecking, all of Fed. Rep. of Germany

[73] Assignee: Siemens Aktiengesellschaft, Berlin and Munich, Fed. Rep. of Germany

[21] Appl. No.: 873,594

[22] Filed: Jun. 11, 1986

[30] Foreign Application Priority Data

Jun. 19, 1985 [DE] Fed. Rep. of Germany ..... 3521890

[51] Int. Cl.[4] ..... H01R 4/66

[52] U.S. Cl. ..... 439/609

[58] Field of Search ..... 339/14 R, 143 R; 439/607, 608, 609, 610

[56] References Cited

U.S. PATENT DOCUMENTS

| | | | |
|---|---|---|---|
| 3,857,029 | 6/1971 | Knowles | 339/14 R |
| 4,500,159 | 2/1985 | Briones et al. | 339/143 R X |
| 4,550,960 | 11/1985 | Asick et al. | 339/14 R |
| 4,571,012 | 2/1986 | Bassler et al. | 339/14 R |
| 4,601,527 | 7/1986 | Lemke | 339/14 R |

FOREIGN PATENT DOCUMENTS

| | | | |
|---|---|---|---|
| 0040941 | 12/1981 | European Pat. Off. . | |
| 0073957 | 3/1983 | European Pat. Off. . | |
| 0118168 | 9/1984 | European Pat. Off. . | |
| 1188633 | 3/1965 | Fed. Rep. of Germany . | |
| 2909627 | 9/1980 | Fed. Rep. of Germany . | |
| 2910906 | 10/1980 | Fed. Rep. of Germany | 339/143 R |
| 140846 | 9/1930 | Switzerland | 339/143 R |
| 917995 | 2/1963 | United Kingdom . | |

*Primary Examiner*—Z. R. Bilinsky

*Attorney, Agent, or Firm*—Hill, Van Santen, Steadman & Simpson

[57] ABSTRACT

A shielding device lying approximately flush against the side walls of a centering strip is formed by at least one shielding element and comprises spring elements which press resiliently against the shielding of a plug in the plugged condition of this plug. The shielding is connected to the grounded potential layer of a subrack with screws, being connected thereto via fastening tabs arranged at the shielding elements.

10 Claims, 3 Drawing Figures

MULTI-POLE PLUG MECHANISM COMPRISING A CENTERING STRIP WITH A SHIELDING DEVICE

BACKGROUND OF THE INVENTION

1. Field of the Invention

The invention relates to a multi-pole plug mechanism comprising a centering strip that can be put in place on a motherboard and serves for the acceptance of a plug and has a shielding device which is electrically connected to regions of subrack holding the motherboard which lie at grounded potential.

2. Description of the Prior Art

German OS No. 29 09 627 discloses that the centering strip of a plug mechanism is provided with a metallic shielding plate which extends essentially perpendicular to the plugging direction and comprises openings for the passage of plug contacts or terminal elements. The shielding plate is electrically connected to regions of a subrack that lie at grounded potential, being connected thereto either directly or via fastening elements. a self-sticking metal foil which is glued to that side of the centering strip facing away from the plug is employed as a shielding plate. Increased signal processing speeds and, thus, stronger noise fields of the signal lines, as well as the growing number of poles of the plug connections require a more effective shielding of the plugs, of the plug strips and of the centering strips.

SUMMARY OF THE INVENTION

An object of the present invention is to improve the shielding of the centering strip of a plug mechanism and to keep the connection to the grounded potential layer low-impedance.

This object is achieved in that the shielding device is formed by at least one separate shielding element comprising shielding surfaces or areas aligned parallel to the plug-in direction which lie at least approximately flush against the lateral surfaces of the centering strip; and in that spring elements are arranged such at the shielding surfaces or areas that these lie resiliently against a shielding of the plug in the plugged condition of the plug.

An advantage of the invention is that both the shielding of the centering strip as well as the electrical connection of the subrack lying at grounded potential ensues by means of a single shielding device which is formed by at least one shielding element. Moreover, the roughly positive molding of the shielding elements to the centering strip requires only a small mounting space.

One embodiment of the invention represents a structurally simple and, thus, cost-favorable solution for a plurality of multi-pole plug mechanisms arranged at a suitable, i.e. slight distance from one another. The two longitudinal side shielding surfaces or areas of neighboring centering strips are combined in one shielding surface or area. The shielding effect is not diminished due to this design.

A further advantageous embodiment of the invention provides that the spring elements are arcuately bend back onto themselves and lie parallel to the plug-in direction of the plugs in recesses of the centering strip which are provided for this purpose. These spring elements and the projections latched into the recesses of the spring strip guarantee a reliable hold of the shielding elements on the centering strip and prevent the lift-off of the shielding elements when the plugs are pulled.

Another advantageous embodiment of the invention provides depressions in the shielding of the cable plug into which the spring elements engage and lie flush. The retaining force of the spring elements makes an unintentional lift-off of the cable plug more difficult.

BRIEF DESCRIPTION OF THE DRAWINGS

Two exemplary embodiments of the invention shall be set forth in greater detail below with reference to the drawing. Thereby shown are.

DESCRIPTION OF THE PREFERRED EMBODIMENTS

Figure 1:
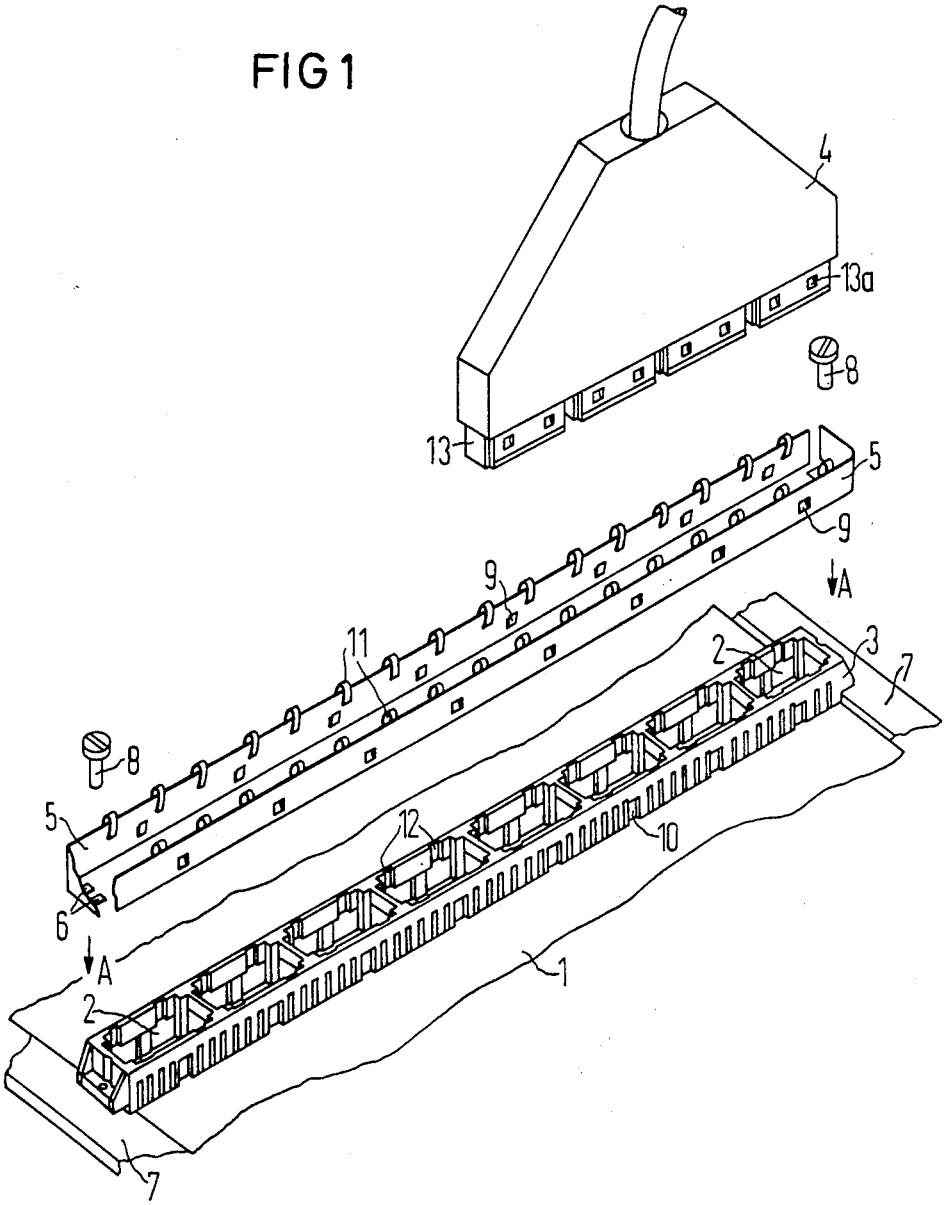
FIG. 1 is an exploded perspective view of an exemplary embodiment of shielding devices for centering strips having an arbitrary spacing of the plug mechanism.

FIG. 1 shows a motherboard 1 on which a centering strip 3 provided with a plurality of roughly rectangular passages 2 is arranged. The passages 2 serve for the passage of plug contacts (not shown) and of cooperating contacts (not shown) of a cable plug 4 connected to the motherboard 1. Two metallic shielding elements 5 are slipped over the centering strip 2 in the plug-in direction A indicated by arrows. Every shielding element 5 lies approximately flush against the longitudinal outside surfaces of the centering strip 3 which extend parallel to the plug-in direction A. The shorter legs of the shielding elements 5 bent at a right angle at the end of the centering strip form the shielding of the end face of the centering strip 3. Fastening tabs 6 are fashioned at those edges of the shorter sides of the shielding elements 5 that are directed toward the motherboard 1, these fastening tabs 6, residing at a right angle to the end face, extending up to the centering strip 3. Together with the centering strip 3, the shielding elements 5 are secured to a subrack 7 with screws 8 via these fastening tabs 6. An electrical connection to the subrack 7 lying at grounded potential thus arises. The longitudinal insides of the shielding elements 5 comprise projections 9 which engage into recesses 10 provided for this purpose, engaging thereinto while being slipped onto the centering strip 3. The rectangular recesses 10 are situated in those longitudinal outsides of the centering strip 3 which extend parallel to the plug-in direction. Each passage of the centering strip 3 has one recess 10 per shielding element 5 allocated to it. Spring elements 11 are fashioned at suitable intervals at those edges of the shielding elements 5 which face away from the motherboard 1, being fashioned such that they will be received and lie in recesses 12 provided for this purpose in the passages 2 of the centering strip 3. The spring elements 11 are arcuately bent back onto themselves such that they resiliently press against the shielding 13 of the plug 4 in the plugged condition of this plug 4 and produce the electrical connection to the shielding elements 5. During the plugging in of the cable plug 4, the spring elements 11 engage into the hemispherically inwardly arced depressions **13*a* of the shielding of the cable plug 4. Instead of the illustrated cable plug 4**, a module plug with correspondingly arranged contact surfaces can also be plugged.

Figures 2A, 2B:
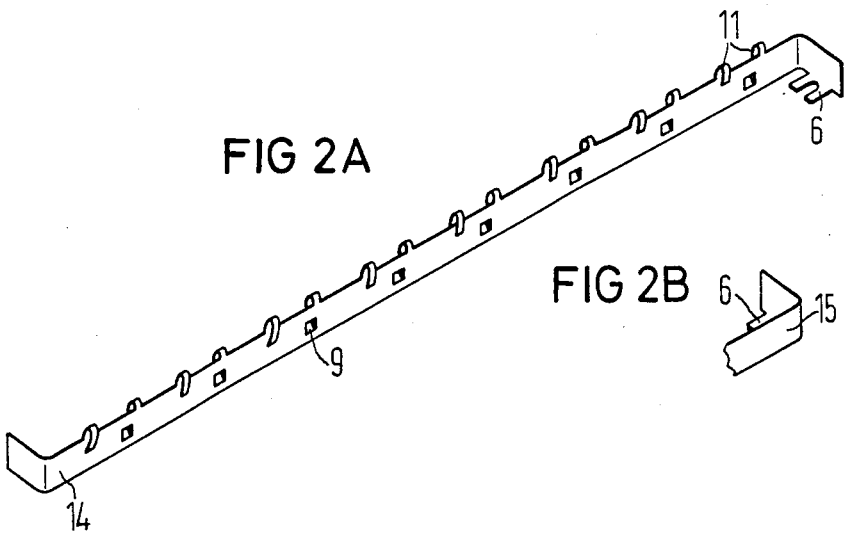
FIG. 2A is a perspective view of an embodiment of a shielding device for centering strips given a suitable spacing of the plug mechanism.
FIG. 2B is a partial perspective view of an embodiment of a shielding device.

FIG. 2A shows a further embodiment of a shielding element 14 which is utilized given an arrangement of a plurality of multi-pole plug mechanisms having a suitable, i.e. small spacing of the centering strips. The elongated region of this shielding element 14 assumes the shielding of neighboring longitudinal outside surfaces of centering strips. Spring elements as described in FIG. 1 are fashioned such at the upper edge of this region of the shielding element 14 that they alternately engage into recesses of both neighboring centering strips, these recesses being provided for this purpose. This region of the shielding element 14 also comprises projections 9 which, as shown in FIG. 1, engage into recesses of a centering strip. In contrast to the shielding element 5 of FIG. 1, this shielding element 14 is bent at right angles at both ends but in opposite directions in order to achieve the shielding of the end faces of neighboring centering strips (not shown). Fastening tabs 6 which extend in the direction toward the centering strip are arranged at right angles relative to these end faces. The fastening tabs 6 serve for the common fastening of the shielding element 14 and centering strip to a subrack.

FIG. 2B shows an alternative to FIG. 2A wherein the shielding element 15 is bent at right angles at both ends but in the same direction in order to achieve the shielding of the end faces of a single centering strips (again not shown). The fastening tabs 6 are arranged as described in FIG. 2A.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A multi-pole plug mechanism comprising a centering strip having side walls which can be put in place on a motherboard and serves for the acceptance in a plug-in direction of a plug equipped with a shielding, said centering strip having a shielding device which is electrically connected to regions of a subrack holding said motherboard that lie at grounded potential wherein said shielding device is formed by at least one separate shielding element comprising shielding surfaces aligned parallel to the plug-in direction which lie at least approximately flush against the side walls of said centering strip; and in that spring elements are arranged such at said shielding surfaces that said spring elements press resiliently against the shielding of the plug in the plugged condition of said plug.

2. A multi-pole plug mechanism according to claim 1, wherein two metallic, rectangularly bend shielding elements are provided, these respectively lying against a longitudinal outside and an face of said centering strip.

3. A multi-pole plug mechanism according to claim 1, wherein given a plurality of multi-pole plug mechanisms arranged in parallel next to one another, only one metallic shielding element is inserted between adajcent plug mechanisms, said spring elements of said shielding element being directed toward both sides and engaging into neighboring centering strips.

4. A multi-pole mechanism according to claim 3, wherein a shielding surface is arranged at both ends of said shielding element and both shielding surfaces or areas press against the end faces of one centering strip.

5. A multi-pole mechanism according to claim 3, wherein a shielding surface is arranged at both ends of said shielding element, said end shielding surfaces lying against opposite end faces of neighboring centering strips.

6. A multi-pole plug mechanism according claim 1, wherein the spring elements are arcuately bent back onto themselves and lie parallel to the plug-in direction of the plugs, lying in recesses of the centering strip which are provided for this purpose.

7. A multi-pole plug mechanism according to claim 1, wherein the shielding elements are equipped with fastening tabs which are secured to the subrack together with the centering strip.

8. A multi-pole plug mechanism according to claim 1, wherein the shielding elements comprise projections at their insides and said centering strip comprises recesses on its outer sides, said projections engaging into said recesses located at outsides of the centering strip.

9. A multi-pole plug mechanism according to claim 1, wherein the shielding of the plug comprises depressions into which the spring elements engage and lie flush.

10. A multi-pole mechanism comprising a centering strip which is mounted on a motherboard, said centering strip having side walls defining passages for the passage of plug contacts and for receiving in a plug-in direction a cable plug equipped with a shielding, said centering strip further having a shielding device which is electrically connected to regions of a subrack holding said motherboard that lie at grounded potential, said shielding device comprising at least one separate shielding element having shielding surfaces aligned parallel to the plug-in direction which lie at least approximately flush against the side walls of said centering strip; said shielding device further having spring elements formed thereon which have portions received is recesses formed in said centering strip passages such that said spring elements press resiliently against the shielding of the plug which is inserted into said centering strip passages in the plugged condition of said plug.

* * * * *